US012038257B2

(12) United States Patent
Johannes van Riel

(10) Patent No.: US 12,038,257 B2
(45) Date of Patent: Jul. 16, 2024

(54) BALLISTIC PANEL

(71) Applicant: Rudolf Emanuel Johannes van Riel, Drunen (NL)

(72) Inventor: Rudolf Emanuel Johannes van Riel, Drunen (NL)

(73) Assignee: Rudolf Emanuel Johannes Van Riel, Drunen (NL)

( * ) Notice: Subject to any disclaimer, the term of this patent is extended or adjusted under 35 U.S.C. 154(b) by 0 days.

(21) Appl. No.: 18/001,717

(22) PCT Filed: May 11, 2021

(86) PCT No.: PCT/NL2021/050307
§ 371 (c)(1),
(2) Date: Dec. 14, 2022

(87) PCT Pub. No.: WO2021/256919
PCT Pub. Date: Dec. 23, 2021

(65) Prior Publication Data

US 2023/0324150 A1 Oct. 12, 2023

(30) Foreign Application Priority Data

Jun. 17, 2020 (NL) ..... 2025843

(51) Int. Cl.
*F41H 5/24* (2006.01)
*F41H 5/013* (2006.01)

(52) U.S. Cl.
CPC ..... *F41H 5/24* (2013.01); *F41H 5/013* (2013.01)

(58) Field of Classification Search
CPC ..... F41H 5/24
See application file for complete search history.

(56) References Cited

U.S. PATENT DOCUMENTS 377,732 A * 2/1888 Adams ..... F41H 5/08 2/2.5
3,820,294 A * 6/1974 Parker ..... E04B 2/40 52/262

(Continued)

FOREIGN PATENT DOCUMENTS

CN 105783601 A 7/2016
DE 102012021201 A1 4/2014

(Continued)

*Primary Examiner* — Joshua E Freeman
(74) *Attorney, Agent, or Firm* — N.V. Nederlandsch Octrooibureau

(57) ABSTRACT

A ballistic panel (1) for assembling a ballistic wall assembly (2), comprising a planar main plate member (3) and two spaced apart L-shaped hook members (8, 9) arranged along a first side edge (6) of the main plate member (3). Each hook member (8, 9) comprises a base portion (10, 11) connected to the first side edge (6), and a leg portion (12, 13) connected to the base portion (10, 11) extending therefrom parallel to the first side edge (6) toward a top edge (4) of the main plate member (3). A gap (14, 15) is provided between each leg portion (12, 13) and the first side edge (6). The main plate member (3) further comprises two spaced apart slots (16, 17) each being arranged opposite to a corresponding opposing hook member (8, 9) and extending along a second side edge (7) of the main plate member (3).

17 Claims, 7 Drawing Sheets

(56) References Cited

U.S. PATENT DOCUMENTS 4,843,947 A * 7/1989 Bauer ..... F41H 5/08 2/2.5
6,394,007 B2 * 5/2002 Lewis ..... E05D 7/14 29/521
6,676,113 B2 * 1/2004 Christensen ..... E01F 13/022 256/25
6,842,908 B1 * 1/2005 Saito ..... F41H 1/02 2/2.5
7,159,503 B1 * 1/2007 Weatherwax ..... F41H 5/24 86/50
D599,488 S * 9/2009 Christensen ..... D25/48.5
7,789,585 B2 * 9/2010 Christensen ..... E01F 13/022 116/63 P
9,260,829 B1 * 2/2016 Maus ..... E01F 13/022
9,624,630 B1 * 4/2017 Maus ..... E01F 13/022
10,941,530 B2 * 3/2021 Calby ..... E01F 13/02
11,142,903 B1 * 10/2021 Jones, Jr. ..... E04B 2/7405
11,572,691 B1 * 2/2023 Newton ..... E04C 2/46
2005/0132873 A1 * 6/2005 Diaz Supisiche ..... E05G 1/024 89/36.01
2010/0326001 A1 * 12/2010 Herron ..... E04B 2/12 52/576
2012/0291619 A1 * 11/2012 White ..... F41H 5/08 89/937
2013/0072086 A1 * 3/2013 Saneshige ..... A63H 33/008 446/478
2015/0308792 A1 * 10/2015 Tyler ..... F41H 5/24 89/36.02
2016/0053483 A1 * 2/2016 Phillips ..... F41H 5/24 52/574
2016/0076238 A1 * 3/2016 Elliott ..... E04C 2/30 52/745.13
2018/0073841 A1 * 3/2018 DeKort ..... F41H 5/08
2018/0258636 A1 * 9/2018 Rahmanian ..... F41H 5/24
2019/0014574 A1 1/2019 Shao et al.
2019/0033041 A1 * 1/2019 Fornusek ..... F41H 5/24
2019/0145741 A1 * 5/2019 Spransy ..... F41H 5/013 89/36.05
2019/0353465 A1 * 11/2019 Muth ..... F41H 5/24
2021/0080229 A1 * 3/2021 Fisher ..... F41H 5/14

FOREIGN PATENT DOCUMENTS

DE 202018001126 U1 8/2018
DE 102018116495 A1 1/2019
EP 3581874 A1 12/2019
WO 2017/134563 A1 8/2017

* cited by examiner

BALLISTIC PANEL

FIELD OF THE INVENTION

The present invention relates to a ballistic panel, in particular a mobile ballistic panel for rapid construction and deployment of modular ballistic wall assemblies.

BACKGROUND ART

US patent application US 2009/0100997 A1 discloses a modular ballistic wall assembly which is bullet, blast and attack resistant, wherein the wall assembly provides a security barrier for protecting personnel, equipment, and other valuable structure. The wall assembly comprises a rigid frame including first and second spaced-apart uprights, and at least one cross-member extending between the uprights. A plurality of ballistic panels are carried by the frame between the first and second uprights. Each ballistic panel has top and bottom edges, opposing side edges, and opposing major surfaces. The major surfaces define respective threat and lee sides of the panel. The ballistic panels are arranged edge-to-edge, such that adjacent panels form an unprotected seam there between. A first ballistic seam protector is carried by the cross-member of the frame, and covers the unprotected seam on the threat-side of the ballistic panels. A second ballistic seam protector is carried by one of the first and second uprights of the frame on the threat-side of the ballistic panels. The second ballistic seam protector is adapted for covering a second unprotected seam formed between adjacent ballistic panels.

International patent application WO 2017/134563 A1 discloses a ballistic panel for special check points, special fortified post, mobile city barriers, diplomatic buildings, buildings of strategic infrastructure, barriers for blast absorption in technological structures and absorption of blast generated fragments. In an embodiment, the ballistic panel comprises locks that are created by skipping material on the top or bottom surface of the ballistic panel and wherein the locks pervade through the whole thickness of the ballistic panel. Furthermore, a ballistic system is disclosed by at least two ballistic panels that are connected together by locks, wherein the connection is created by insertion of the locks together, so that the ballistic panels defined by their outer dimensions intersect each other by consisting of different numbers of ballistic panels that can have different shapes and dimensions.

Prior art ballistic wall assemblies such as those described above comprise various components and panels of different shapes that need to be managed when completing the wall assembly. As a result, considerable planning is still required by users building a stable wall assembly, wherein the time needed to complete the wall assembly remains relatively long, particularly when a complex wall assembly configuration is required during emergencies.

SUMMARY OF THE INVENTION

The present invention seeks to provide an improved ballistic panel, in particular a mobile ballistic panel for rapid construction and deployment of ballistic wall assemblies, wherein the ballistic panel overcomes at least some of the problems of the prior art as mentioned above. The ballistic panel of the present invention not only minimizes the number of components needed for assembling a ballistic wall assembly but it also allows for various wall configurations to be built conveniently without the need for special components and tools. Furthermore, the ballistic wall panel is light weight and as such can be easily carried and manoeuvred into place.

According the present invention, a ballistic panel is provided of the type mentioned in the preamble above, comprising a planar main plate member of ballistic material comprising a top edge, an opposing bottom edge, a first side edge and an opposing second side edge. Two spaced apart L-shaped hook members are provided and arranged along the first side edge, wherein each hook member comprises a base portion connected to the first side edge, and a leg portion connected to the base portion and extending away therefrom parallel to the first side edge toward the top edge, wherein a gap/slit is provided between the leg portion and the first side edge.

The main plate member further comprises two spaced apart slots each of which is arranged opposite to a corresponding opposing hook member of the two hook members and extending along the second side edge, and wherein each slot is configured to releasably receive one of two L-shaped hook members of another ballistic panel, i.e. another ballistic panel of the present invention.

According to the present invention, the ballistic panel allows for convenient assembly of a ballistic wall by insertion of two L-shaped hook members of a first ballistic panel into two corresponding slots of a second ballistic panel, wherein the first and second ballistic panels are ballistic panels of the present invention. Once inserted, the main plate member of the first ballistic panel extends through the gap between each leg portion of the two hook members and the first side edge of the second ballistic panel. Through such a hook-slot engagement the first and second ballistic panels are arranged at substantially 90° degree to one another and form an intrinsically stable ballistic wall assembly. In particular, the substantially perpendicular panel arrangement allows the first and second ballistic panels to stand, e.g., on both their bottom edges so that a stable ballistic wall assembly is obtained. Furthermore, the substantially perpendicular arrangement between the first and second ballistic panels form a concave enclosure behind or within which a person can stand for ballistic protection.

From the above it is clear that the ballistic panel of the present invention does not require the use of tools to build a ballistic wall assembly, and where the use of fasteners, brackets and the like is circumvented for connecting two ballistic panels. This ensures that ballistic wall assemblies can be assembled in nearly every location imaginable and with great speed.

In an embodiment, the main plate member is rectangular or square and wherein the top edge, bottom edge, first side edge and the second side edge are straight edges. These straight edges allow the main plate member to snugly engage a main plate member of another ballistic panel with minimal seams between the main plate members.

In an advantageous embodiment, the ballistic panel may further comprise two bottom edge plates of ballistic material attached to the main plate member along the bottom edge thereof and wherein the two bottom edge plates are arranged in opposing fashion on either side of the main plate member, wherein each of the two bottom edge plates extend beyond the bottom edge of the main plate member by an extending distance larger than zero. In this embodiment the bottom edge of the main plate member is covered by two bottom edge plates that are arranged on opposing sides of the main plate member. Since both bottom edge plates extend beyond the bottom edge, this allows an upper first ballistic panel to be vertically stacked on a lower second ballistic panel whilst providing lateral stability as the bottom edge of the first ballistic panel rests on the top edge of the second ballistic panel and wherein the two bottom edge plates of the first ballistic panel in part overlap the main plate member of the second ballistic panel. A further advantage of the two bottom edge plates of the ballistic panel is that a seam between the bottom edge of a first ballistic panel and the top edge of the second ballistic panel will be protected when the first and second ballistic panels are vertically stacked.

SHORT DESCRIPTION OF DRAWINGS

The present invention will be discussed in more detail below, with reference to the attached drawings, in which FIG. 1 shows a ballistic wall assembly comprising a plurality of ballistic panels according to an embodiment of the present invention;

FIG. 8 shows a plan view of a second configuration of a ballistic wall assembly according to an embodiment of the present invention; and wherein

DESCRIPTION OF EMBODIMENTS

Figure 1:
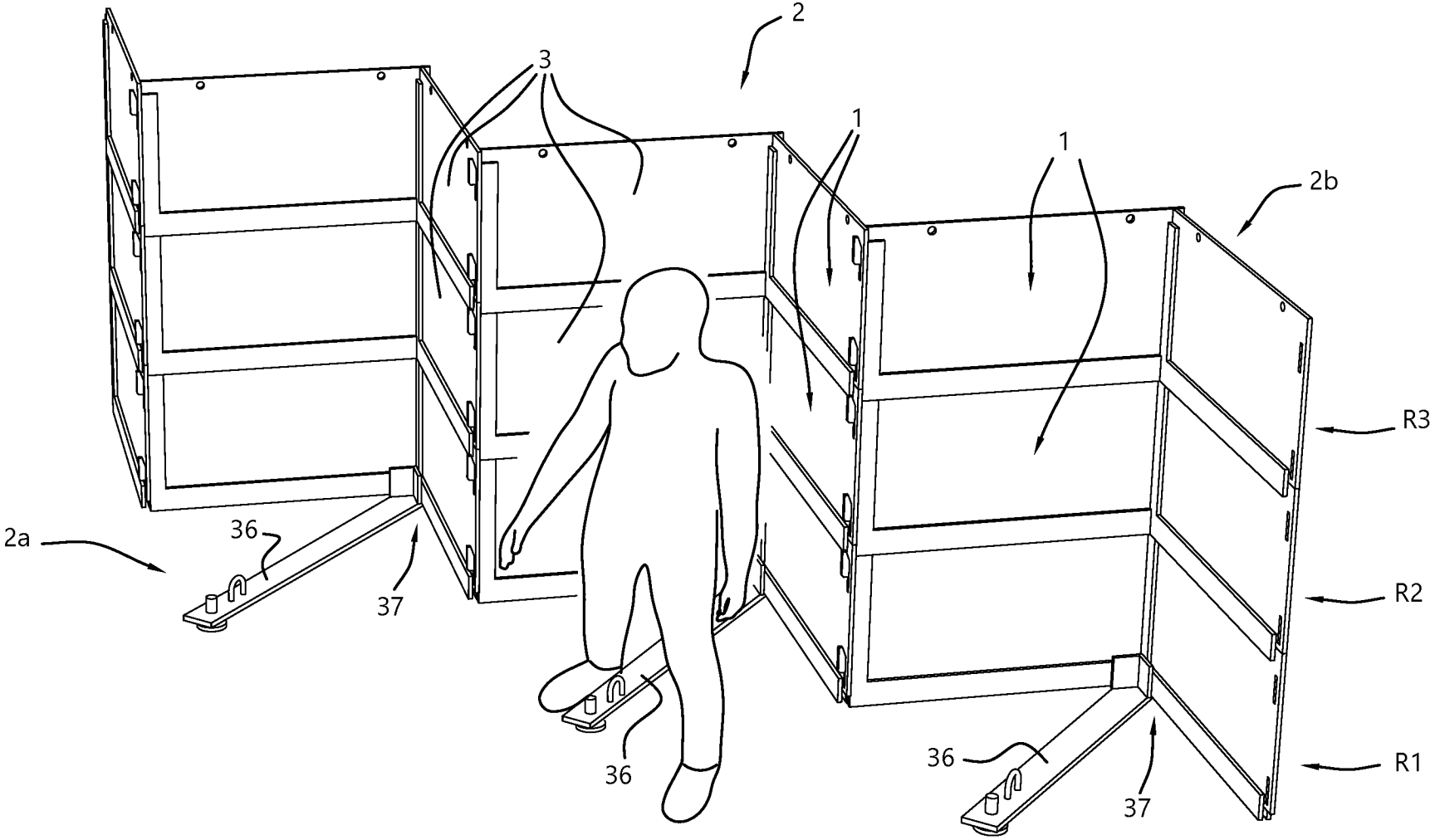

FIG. 1 shows a ballistic wall assembly comprising a plurality of ballistic panels according to an embodiment of the present invention. As shown, a plurality of ballistic panels 1 are provided and connected to form a ballistic wall assembly 2 capable of protecting a person "P" on a lee side 2*a* of the wall assembly 2 against various types of projectiles (not shown) coming from a threat side 2*b* of the wall assembly 2. Each of the ballistic panels 1 as shown comprises a planar main plate member 3 of ballistic material capable of withstanding impact of a projectile. It is worth noting that in an advantageous embodiment, each main plate member 3 provides ballistic protection from both the lee side 2*a* as well as the threat side 2*b*. This allows the ballistic panel 1 to be used in arbitrary fashion, so that when a user builds the ballistic wall assembly 2 need not take into consideration whether a ballistic panel 1, and in particular the main plate member 3 thereof, has a required threat side that should face toward the direction of a threat, e.g. incoming projectiles. In this embodiment, the main plate member 3 is therefore threat neutral in that equal ballistic protection is provided on both sides of the main plate member 3. This in turn allows the person P to move to the side 2*b* of the ballistic wall assembly 2 and remain protected in case an unexpected threat would appear on the side 2*a* of the ballistic wall assembly 2.

The ballistic materials that can be used for the ballistic panel 1 of the present invention, e.g. the main plate member 3, may be known materials for that purpose. For example, ballistic nylon, Kevlar, ballistic fabrics, ballistic ceramics, metals, plastics, and/or suitable types of wood (e.g. hardwood) may all be used either individually or in any combination conceivable when so desired and technically feasible. In any case, since the ballistic panel 1 is most preferably carried by a single person, the ballistic material used should be as light as possible.

Furthermore, in advantageous embodiments the ballistic panel 1, e.g. the main plate member 3, may be provided with one or more colours, coloured patterns (e.g. camouflage) and the like allowing the ballistic panel 1 to blend into its surrounding environment to make it less visible for example.

Figure 2:
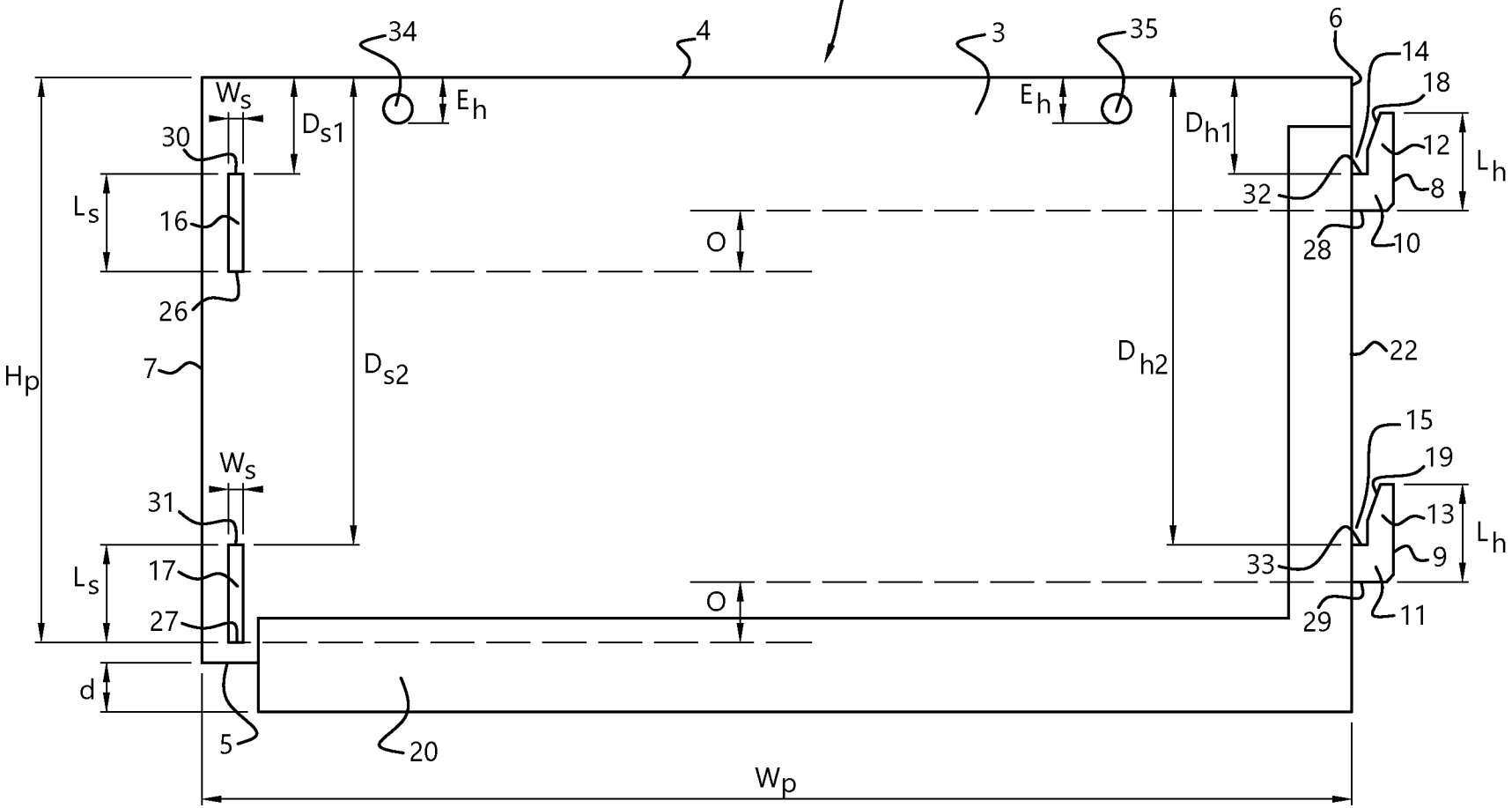
FIG. 2 shows a plan view of a ballistic panel according to an embodiment of the present invention.
Figure 3:
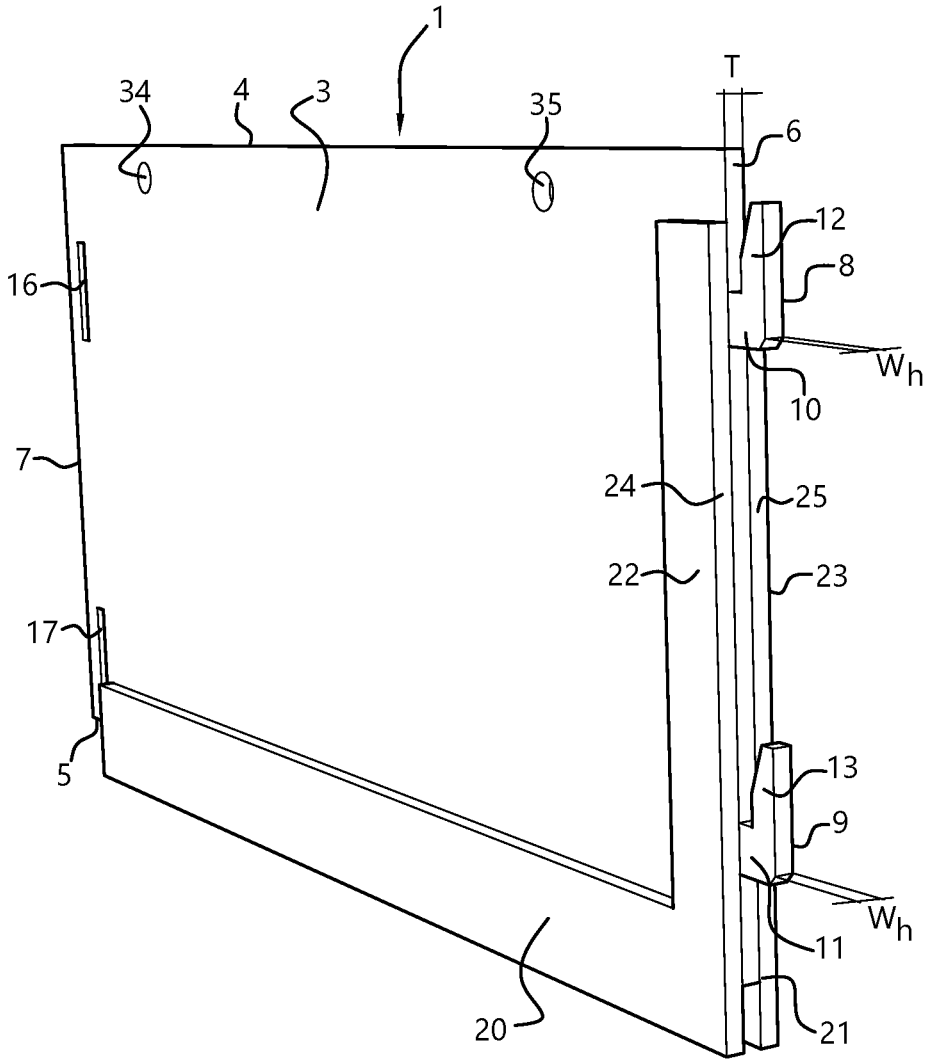
FIG. 3 shows a three dimensional view of a ballistic panel according to another embodiment of the present invention.
Figure 4:
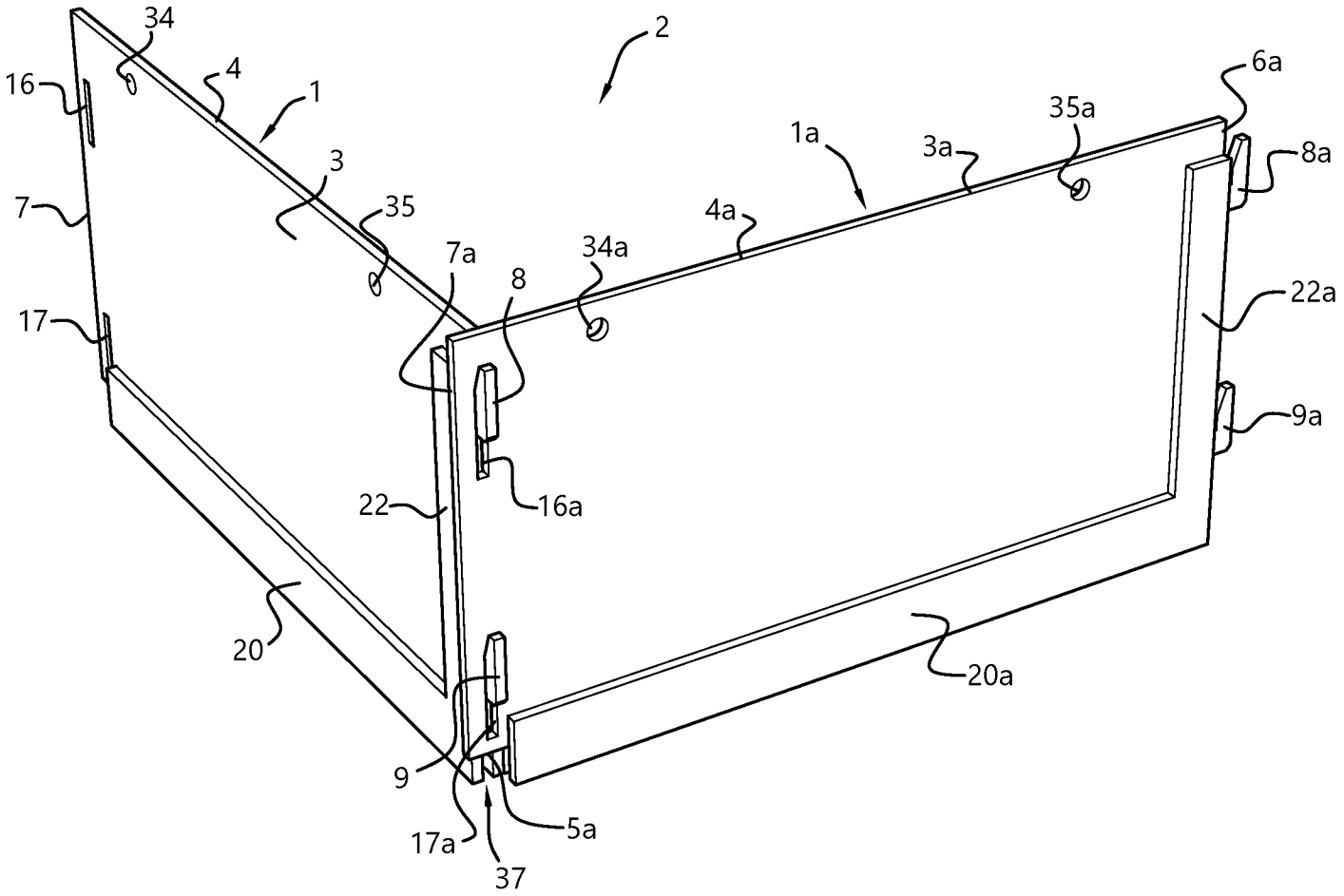
FIG. 4 shows a ballistic wall assembly comprising two connected ballistic panels according to an embodiment of the present invention.

To go into further details on the ballistic panel 1 of the present invention and how it is able to provide fast and modular assembly of a ballistic wall assembly, FIG. 2 and FIG. 3 show a plan view and a three-dimensional view, respectively, of a ballistic panel 1 according to an embodiment of the present invention. FIG. 4 then shows a ballistic wall assembly 2 comprising two connected ballistic panels 1, 1*a* according to an embodiment of the present invention.

In the embodiments shown, the ballistic panel 1 for assembling the ballistic wall assembly 2 comprises a planar main plate member 3 of ballistic material comprising a top edge 4 and an opposing bottom edge 5, and a first side edge 6 and an opposing second side edge 7. Two spaced apart L-shaped hook members 8, 9 are provided and arranged along the first side edge 6, wherein each hook member 8, 9 comprises a base portion 10, 11 connected to the first side edge 6, and a leg portion 12, 13 connected to the base portion 10, 11 and extending away therefrom parallel to the first side edge 6 toward the top edge 4. A gap or slit 14, 15 is provided between the leg portion 12, 13 of each hook member 8, 9 and the first side edge 6 of the main plate member 3.

As further depicted, the main plate member 3 comprises two spaced apart slots 16, 17, e.g. elongated slots, each of which is arranged opposite, i.e. substantially opposite, from a corresponding opposing hook member 8, 9 of the two hook members 8, 9 and extending along the second side edge 7. Each slot 16, 17 is then configured to releasably receive one of two L-shaped hook members of another or second ballistic panel of the present invention.

It is important to note that each of the two hook members 8, 9 of the ballistic panel 1 are configured and shaped to cooperatively and releasably extend through the opposing corresponding slots 16, 17. This will allow another further/second ballistic panel 1*a* and the two slots 16*a*, 17*b* thereof to cooperatively and releasably engage the two L-shaped hook members 8, 9 of the ballistic panel 1. Of course, it will not be possible to insert the two hook members 8, 9 in the opposing corresponding two slots 16, 17 of the same ballistic panel 1. However, given the ballistic panel 1 and a second ballistic panel 1*a* of the present invention allows for mutual engagement between the first and second ballistic panels 1, 1*a* through a corresponding hook-slot engagement, wherein the two L-shaped hook members 8, 9 of the ballistic panel 1 fit in corresponding two slots 16*a*, 17*a* of the second ballistic panel 1*a*.

In FIG. 4 it is clearly visible that the ballistic panel 1 of the present invention yields a 90° degree ballistic wall assembly 2 between two interconnected ballistic panels 1, 1*a*. That is, the aforementioned first and second ballistic panels 1, 1*a* will be at a substially 90° angle when in hook-slot engagement as depicted and as such an intrinsically stable ballistic wall assembly 2 is obtained.

From the above it is shown that the two L-shaped hook members 8, 9 of the ballistic panel 1 and the opposing two slots 16, 17 of the main plate member 3 allow for extremely fast assembly of a ballistic wall assembly 2 when a plurality of the ballistic panels 1 are used, wherein each of the ballistic panels 1 is easily carried and handled by a single person. The ballistic panels 1 can be connected rapidly through the hook-slot engagement without tools, making the ballistic panel 1 be ideally suited for rapid deployment where time is of the essence.

In an embodiment, each slot 16, 17 of the main plate member 3 comprises a slot length Ls equal to or larger than a hook length Lh of the corresponding opposing hook member 8, 9, and wherein each slot 16, 17 comprises a slot width Ws equal to or larger than a hook width/thickness Wh of the opposing hook member 8, 9. This will allow the two hook members 8, 9 to be received in corresponding slots 16*a*, 17*a* of a second ballistic panel 1*a* of the present invention.

In exemplary embodiments, the slot length Ls and the hook length Lh may be between 5 to 20 cm, e.g. 10, 15 cm. These slot and hook lengths Ls, Lh will in many cases provide a sufficiently strong and reliable hook-slot engagement for forming a stable connection between two ballistic panels.

To get proper fitment between two ballistic panels 1, 1*a*, an embodiment is provided wherein the gap 14, 15 between the leg portion 12, 13 of each hook member 8, 9 and the first side edge 6 is equal or larger than a thickness T of the main plate member 3. In this embodiment, the L-shaped hook members 8, 9 and the gaps 14, 15 provided thereby allow for snug engagement between the first side edge 6 and a main plate member 3*a* of a second ballistic panel 1*a* as exemplified in FIG. 4. That is, the two hook members 8, 9 allow the main plate member 3*a* of the second ballistic panel 1*a* to be held against the first side edge 6 of the ballistic panel 1, thereby minimizing seam forming between the ballistic panels 1, 1*a*. When the thickness T of the main plate member 3 substantially equals the gaps 14, 15, then the L-shaped hook members 8, 9 allow for clamped and snug engagement with the main plate member 3*a* of the second ballistic panel 1*a*, thereby providing a stable connection between the ballistic panels 1, 1*a*.

In exemplary embodiments, the thickness T of the main plate member 3 may be between 1 and 4 cm, e.g. 1.5, 2, 2.5, 3 or 3.5 cm. Of course, the thickness T is dependent on the ballistic materials used and which thickness is then required for a particular protection level.

In an advantageous embodiment, the leg portion 12, 13 of each hook member 8, 9 comprises a tapered end 18, 19 distal to the base portion 10, 11. The tapered ends 18, 19 provide guidance to a user when moving the second ballistic panel 1*a* downwards to slide the main plate member 3*a* of the second ballistic panel into gaps 14, 15 provided by the hook members 8, 9. Therefore, through the tapered ends 18, 19 the second ballistic panel 1*a* need not be accurately positioned parallel along the first side edge 6, so that as the second ballistic panel 1*a* is being moved downwards, then the main plate member 3*a* thereof will be urged against the first side edge 6 in snug fashion to achieve a sturdy hook-slot engagement with the ballistic panel 1.

It is worth noting that the two hook members 8, 9 of the ballistic panel could, in an embodiment, be fastened to the first side edge 6 of the main plate member 3 as separate components. The fastening of the two hook members 8, 9 would not need to be done by a user but this would be performed during the manufacturing process of the ballistic panel 1. In an alternative, advantageous embodiment the main plate member 3 and the two hook members 8, 9 form a single piece component. So in this embodiment, the main plate member 3 and the two hook members 8, 9 may be obtained from a single, unitary planar plate member. In this way the two hook members 8, 9 are integrally formed with the first side edge 6 of the main plate member 3, thereby reducing the number of components of the ballistic panel 1 and as such bring manufacturing costs down. Having the two hook members 8, 9 and the main plate member 3 as a single, unitary piece may also improve strength of the hook member 8, 9.

As suggested by FIG. 4, the two hook members 8, 9 are spaced apart along the first side edge 6 and each hook member 8, 9 is arranged proximal to the top or bottom edge 4, 5. This ensures that a main plate member 3*a* of a second ballistic panel 1*a* completely engages the first side edge 6 of the main plate member 3 in snug, parallel fashion between the top and bottom edge 4, 5 and the two hook member 8, 9.

The above may be clarified by saying that a first hook member 8 of the two hook members 8, 9 is arranged proximal to the top edge 4 and where a second hook member 9 of the two hook members 8, 9 is arranged proximal to the bottom edge 5. The first hook member 8 will then be able to engage the main plate member 3*a* of the second ballistic panel 1*a* proximal to the top edge 4*a* thereof, and wherein the second hook member 9 will then be able to engage the main plate member 3*a* of the second ballistic panel 1*a* proximal to the bottom edge 5*a* thereof.

It is of course understood that the two slots 16, 17 are arranged substantially opposite the two hook members 8, 9 regardless of their position along the first side edge 6. So a first slot 16 of the two slots 16, 17 is arranged substantially opposite from the first hook member 8, and a second slot 17 is arranged substantially opposite from the second hook member 9.

To achieve tight engagement between a plurality of ballistic panels 1 and to minimize open seams, an embodiment is provided wherein the main plate member 3 is rectangular or square wherein the top edge 4, bottom edge 5, first side edge 6 and the second side edge 7 are straight edges. Since all side edges 4, 5, 6, 7 are straight allows a plurality of ballistic panels to tightly engage each other in horizontal and vertical stacked fashion as depicted in FIG. 1.

Figure 5:
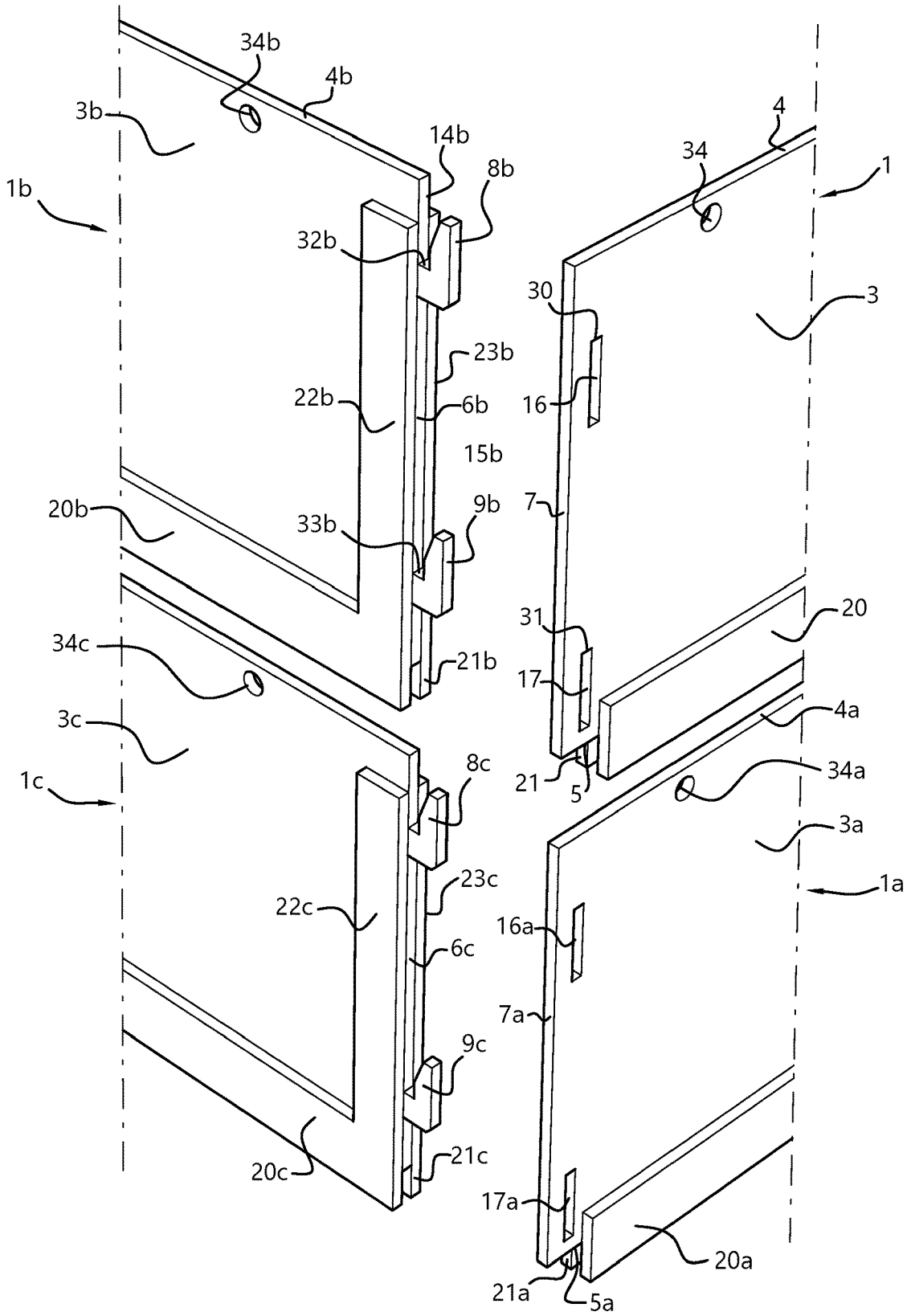
FIG. 5 shows an exploded view of a ballistic assembly according to an embodiment of the present invention.

FIG. 5 shows an exploded view of a ballistic wall assembly 2 according to an embodiment of the present invention. Then with reference to FIGS. 2, 3 and 5, an embodiment is depicted wherein the ballistic panel 1 may further comprise two bottom edge plates 20, 21 of ballistic material that are attached to the main plate member 3 along the bottom edge 5 thereof and wherein the two bottom edge plates 20, 21 are arranged in opposing fashion on either side of the main plate member 3. Furthermore, each of the two bottom edge plates 20, 21 extend beyond the bottom edge 5 of the main plate member 3 by an extending distance "d" larger than zero. As depicted, the two bottom edge plates 20, 21 may be seen as elongated strips arranged along the bottom edge 5 of the main plate member 3. As the two bottom edge plates 20, 21 extend along opposing sides of the main plate member 3 and beyond the bottom edge 5, allows a top edge 4*a* of a main plate member 3*a* of a second ballistic panel 1*a* to be received between the two bottom edge plates 20, 21. In this way the seam between the two main plate members 3, 3*a* is ballistically protected. Moreover, the two main plate members 3, 3*a* are stabilized in sideways fashion by the two bottom edge plates 20, 21 as they prevent the bottom edge 4 of the ballistic panel 1 and the top edge 4*a* of the second ballistic panel 1*a* to move laterally/sideways with respect to one another.

In a further embodiment, as depicted in FIGS. 2 and 3, the ballistic panel 1 may further comprise two side edge plates 22, 23 of ballistic material attached to the main plate member 3 along the first side edge 6 thereof and wherein the two side edge plates 22, 23 are arranged in opposing fashion on either side of the main plate member 3, and wherein each of the two side edge plates 22, 23 comprises an abutment side edge 24, 25 arranged flush with the first side edge 6 of the main plate member 3. In this embodiment the two side edge plates 22, 23, provide for an enlarged side surface to engage a main plate member 3*a* of a second ballistic panel 1*a*. This will reduce horizontal rotation between two connected ballistic panels and as such provides for improved stability. Also, the two side edge plates 22, 23 locally increase the thickness of the main plate member 3 and as such improve ballistic protection along the first side edge 6 when the first side edge 6 engages a main plate member 3*a* of a second ballistic panel 1*a*.

In an advantageous embodiment, each bottom edge plate 20, 21 and each side edge plate 22, 23 that are arranged on a common side of the main plate member 3 form a single piece edge plate. Therefore, a first bottom edge plate 20 and a first side edge plate 22 form a single piece edge plate, and wherein a second bottom edge plate 21 and a second side edge plate 23 also form a single piece edge plate.

In an exemplary embodiment, the two bottom edge plates 20, 21 and the two side edge plates 22, 23 may be adhered or mechanically fastened to the main plate member 3 depending on the ballistic materials used and whether an adhesive or mechanical fasteners is preferred for a particular application. In an even further embodiment it may be contemplated that the two bottom edge plates 20, 21 and the two side edge plates 22, 23 are integrally formed with the main plate member 3 insofar possible for the ballistic materials used.

Referring to FIG. 5, it is noted that the exploded view shown of the ballistic wall assembly 2 indicates how a plurality of ballistic panels 1, 1*a*, 1*b*, 1*c* of the present invention may be assembled. As shown, the depicted ballistic panels 1*a*, 1*b*, 1*c* may be identical to the ballistic panel 1, so that all reference numbers for the various components of the ballistic panels 1*a*, 1*b*, 1*c* are also postfixed by "a", "b", "c" respectively. So, for example, the bottom edge plates 20, 21 of the ballistic panel 1 give rise to second bottom edge plates 20*a*, 21*a*; third bottom edge plates 20*b*, 21*b*; and fourth bottom edge plates 20*c*, 21*c* of a second, third and a fourth ballistic panel 1*a*, 1*b*, 1*c* of the present invention, respectively.

From FIG. 5 it can be deduced that first assembling the second ballistic panel 1*a* and fourth ballistic panel 1*c* together is most convenient as it provides for a stable ballistic wall assembly comparable to the ballistic wall assembly shown in FIG. 4. Subsequently, the ballistic panel 1 and the third ballistic panel 1*b* may be assembled on top of the second and fourth ballistic panel 1*a*, 1*c*. Therefore, to build the ballistic wall assembly 2 shown in FIG. 1, a row based assembling pattern is employed, wherein a user first assembles a first row R1 of ballistic panels, then a second row R2, and a third row R3. Advantageously, a single person P is able to build a ballistic wall assembly 2 of any size deemed necessary.

Further details on how a ballistic panel 1 allows for effective connection to another ballistic panel can be exemplified as follows. Referring to FIGS. 2 and 5, an embodiment is provided wherein each of the two slots 16, 17 comprises a bottom slot end 26, 27 and wherein each of the two hook members 8, 9 comprises a bottom hook end 28, 29, and wherein each bottom slot end 26, 27 is offset by an offset distance "O" of at least the extending distance "d" toward the bottom edge 5 with respect to the corresponding opposing bottom hook end 28, 29. The offset distance O ensures that the two bottom edge plates 20, 21 can be sufficiently lifted upward so that the top edge 4*a* of the second ballistic panel 1*a* is completely retracted from the space between the two bottom edge plates 20, 21 of the ballistic panel 1 arranged above it. In this embodiment the ballistic panel 1 can thus be engaged with the second and third ballistic panels 1*a*, 1*b* as shown in FIG. 5 and be connected thereto or removed therefrom without interference from the two bottom edge plates 20, 21 with the top edge 4*a* of the second ballistic panel 1*a*.

In another embodiment, each of the two slots 16, 17 comprises a top slot end 30, 31 and wherein each of the two hook members 8, 9 comprises a gap bottom 32, 33. Then, each top slot end 30, 31 is arranged at an equal or smaller distance Ds1, Ds2 from the top edge 4 of the main plate member 3 than a distance Dh1, Dh2 of the corresponding opposing gab bottom 32, 33 of an opposing hook member 8, 9. So in this embodiment Ds1<=Dh1 and Ds2<=Dh2. As exemplified in FIG. 5, this embodiment prevents that one or both top slot ends 30, 31 of the ballistic panel 1 would engage corresponding gap bottoms 32*b*, 33*b* of the third ballistic panel 1*b* prematurely. Otherwise the ballistic panel 1 would not be lowered into the gaps 14*b*, 15*b* of the hook members 8*b*, 9*b* of the third ballistic panel 1*b* sufficiently for the top edges 4, 4*b* to become flush with one another.

Going back to FIG. 2, in an embodiment the main plate member 3 comprises one or more holes 34, 35 arranged along the top edge 4 of the main plate member 3. These holes 34, 35 can be used to carry the ballistic panel 1 by, for example, sticking one or more corresponding pins or elongated objects through these holes 34, 35 for grabbing the ballistic panel 1 more conveniently. Of course, the holes 34, 35 may be chosen to be large enough for one or more fingers such that improved manual grip on the ballistic panel 1 is achieved.

In an advantageous embodiment, the one or more holes 34, 35 are arranged at a distance Eh from the top edge 4 of the main plate member 3 less than the extending distance d of the two bottom edge plates 20, 21. Through this embodiment it is possible to cover the one or more holes 34, 35 by two bottom edge plates. For example, in FIG. 5 it is illustrated that the one or more holes 34*a* of the second ballistic panel 1*a* may be covered by the bottom edge plates 20, 21 of the ballistic panel 1, which is placed on top of the second ballistic panel 1*a*. As a result, the one or more holes 34, 35 of the ballistic panel 1 do not give rise to a reduced ballistic protection when another ballistic panel is placed on top.

As mentioned earlier, the purpose of the ballistic panel 1 of the present invention is to allow for modular assembly of a ballistic wall assembly 2 in speedy fashion by circumventing the use of special tools and by preventing the use of connecting components such as fasteners, brackets and the like for connecting ballistic panels together.

Additionally, and preferably, the ballistic panel 1 should be manageable by a single person when carrying and handling each ballistic panel 1. To achieve this an embodiment is contemplated wherein the main plate member 3 has a width Wp and height Hp each of which is equal to or less than 1.5 meter. By keeping the width Wp and height Hp of the main plate member 3 equal to or less than 1.5 meter allows a single person to grab the ballistic panel 1 without stretching the arms too much, thereby achieving ergonomically responsible handling of the ballistic panel 1. Of course, in another embodiment the width Wp and height Hp of the main plate member 3 may each be greater than 1.5 meter, but it may then be necessary to carry and handle the ballistic panel 1 by two persons. Even though assembling the ballistic wall assembly 2 could then become more involved, building a larger ballistic wall assembly 2 is facilitated by utilizing larger ballistic panels 1.

In an advantageous embodiment, the width Wp and height Hp of the main plate member 3 may be chosen so that one or more ballistic panels 1 can be conveniently transported on a EUR/EPAL pallet. For example, in an embodiment the width Wp is at most 120 cm and the height Hp is at most 80 cm according to the width and length specification of a EUR/EPAL pallet. In another embodiment the width Wp is at most 80 cm and the height Hp is at most 120 cm. These embodiments allow one or more ballistic panels 1 to lie flat on a EUR/EPAL pallet in stacked fashion without extending beyond the edges of the EUR/EPAL pallet.

Figure 6:
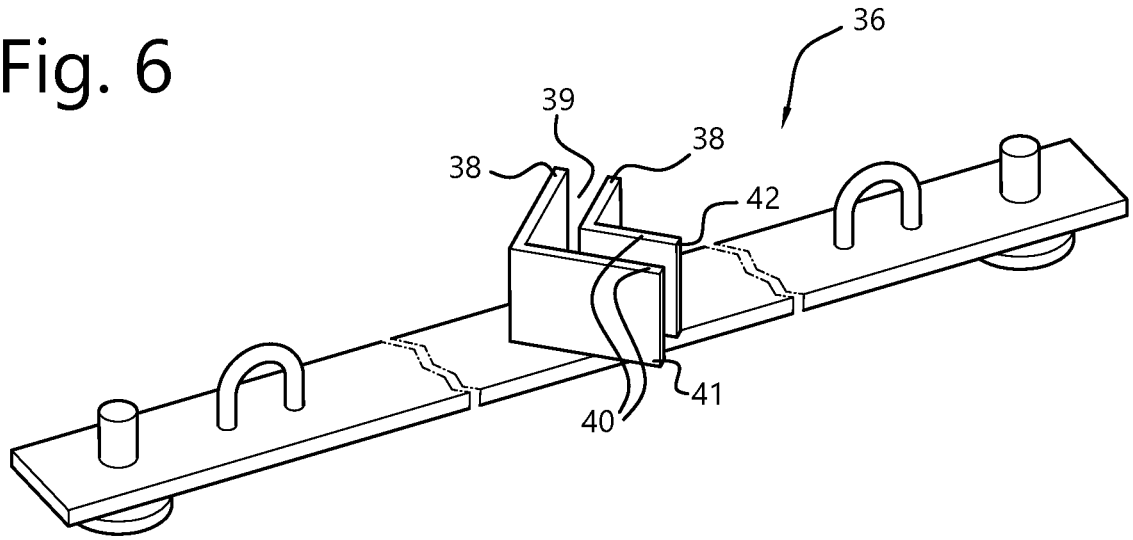
FIG. 6 shows a wall stand according to an embodiment of the present invention.

As mentioned earlier and depicted in FIG. 4, the hook-slot engagement between a ballistic panel 1 and a second ballistic panel 1*a* yields a substantially 90° arrangement between the ballistic panels 1, 1*a* and as such form an intrinsically stable ballistic wall assembly 2. However, should more stability be desired, for example in outdoor windy environments, uneven surfaces, and/or higher ballistic wall assemblies, then FIGS. 1 and 6 show an exemplary wall stand 36 according to an embodiment of the present invention. The wall stand 36 is configured to support a corner 37 between two horizontally engaging ballistic panels 1, 1*a* of the present invention. The wall stand 36 is adapted to be sufficiently long to provide additional lateral stability against tip over of the ballistic wall assembly 2. In an embodiment, the wall stand 36 comprises a receiving member 38 having a receiving space 39 configured to receive a corner 37 of two horizontally engaging ballistic panels 1, 1*a*. In an exemplary embodiment the receiving member 38 comprises a parallel spaced arrangement of clamping plates 40 with the receiving space 39 there between for firmly securing a corner 37 of two horizontally engaging ballistic panels 1, 1*a*. As depicted, the parallel spaced arrangement of clamping plates 40 may comprise two parallel spaced apart plates 41, 42 each of which comprises a 90° bend. In this way each ballistic panel 1, 1*a* is supported on both sides at the corner 37.

According to the present invention, the ballistic panel 1 allows for rapid construction and deployment of a ballistic wall assembly 2, where the ballistic panel 1 allows for various wall configurations to be built conveniently without the need for special components and tools. In particular, FIGS. 7, 8 and 9 each show a plan view of a first, second and a third configuration, respectively, of a ballistic wall assembly 2 according to embodiments of the present invention.

Since the ballistic panel 1 is configured to engage another ballistic panel 1*a* at substantially 90° degrees, the ballistic panel 1 not only provides for inherent lateral stability of a ballistic wall assembly 2 as mentioned earlier, but the 90° degree engagement between ballistic panels 1, 1*a* allows for versatile configurations of enclosures to be built of any peripheral size that partially or fully enclose and protect one or more persons P.

Figure 7:
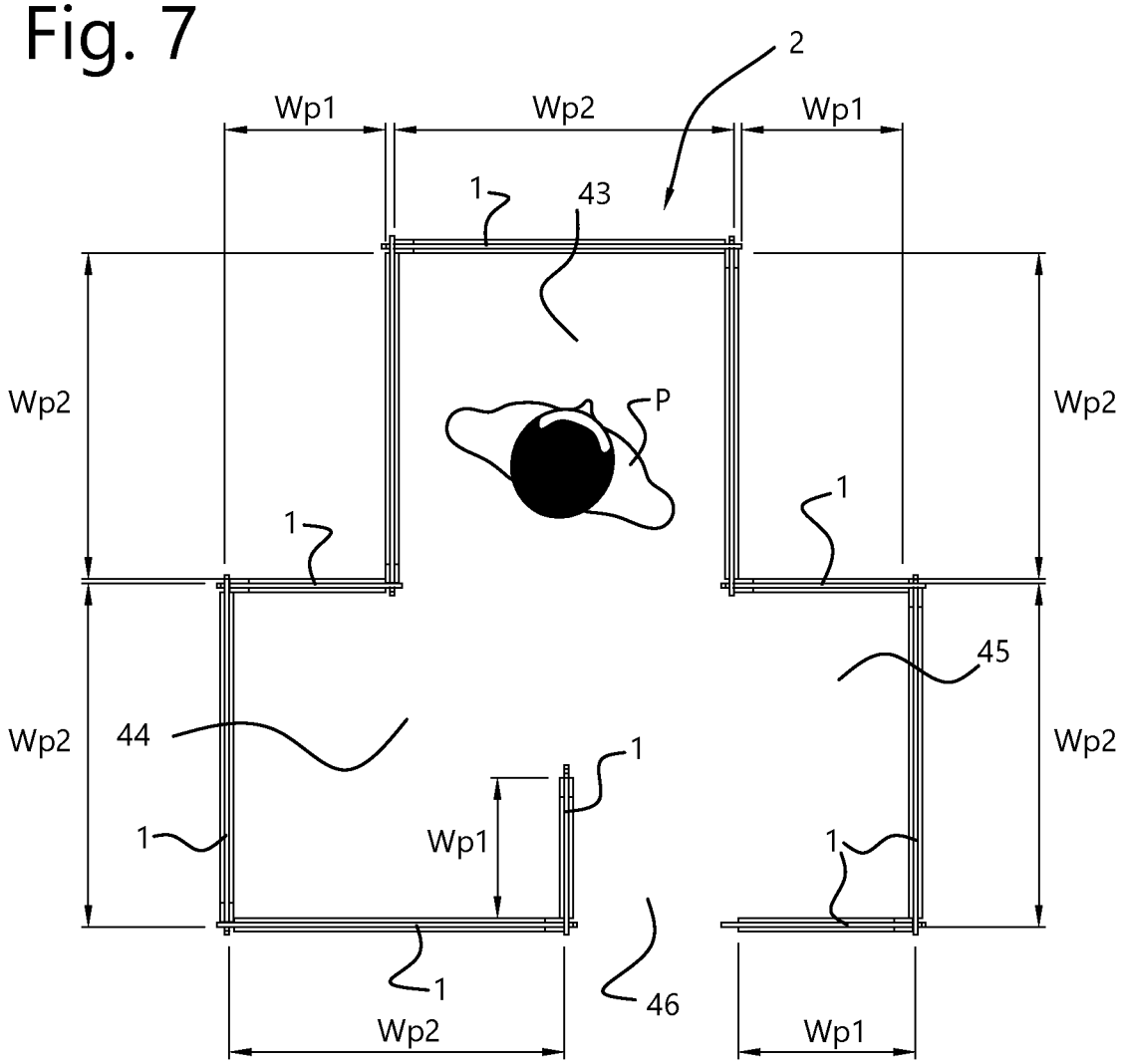
FIG. 7 shows a plan view of a first configuration of a ballistic wall assembly according to an embodiment of the present invention.

For example, FIG. 7 depicts a first exemplary smallest configuration of a ballistic wall assembly 2 of three U-shaped enclosures 43, 44, 45 for protecting a person P. An entrance/exit 46 is provided to allow the person P to enter or leave the ballistic wall assembly 2.

As depicted, it is worth noting that a ballistic wall assembly 2 according to the present invention may comprise ballistic panels 1 having main plate members 3 of different width Wp. This is exemplified in FIG. 7 by ballistic panels 1 having main plate members 3 of width Wp1 versus main plate members 3 of width Wp2. In this particular embodiment the width Wp1 may be half of the width Wp2 for example. However, it must be pointed out that a vertical arrangement or column of two or more stacked ballistic panels 1 in a ballistic wall assembly 2 may require that all main plate members 3 in the column have equal width, e.g. Wp1 or Wp2. This ensures compatible vertical and horizontal fitment of further ballistic panels 1 of the ballistic wall assembly 2.

Figure 8:
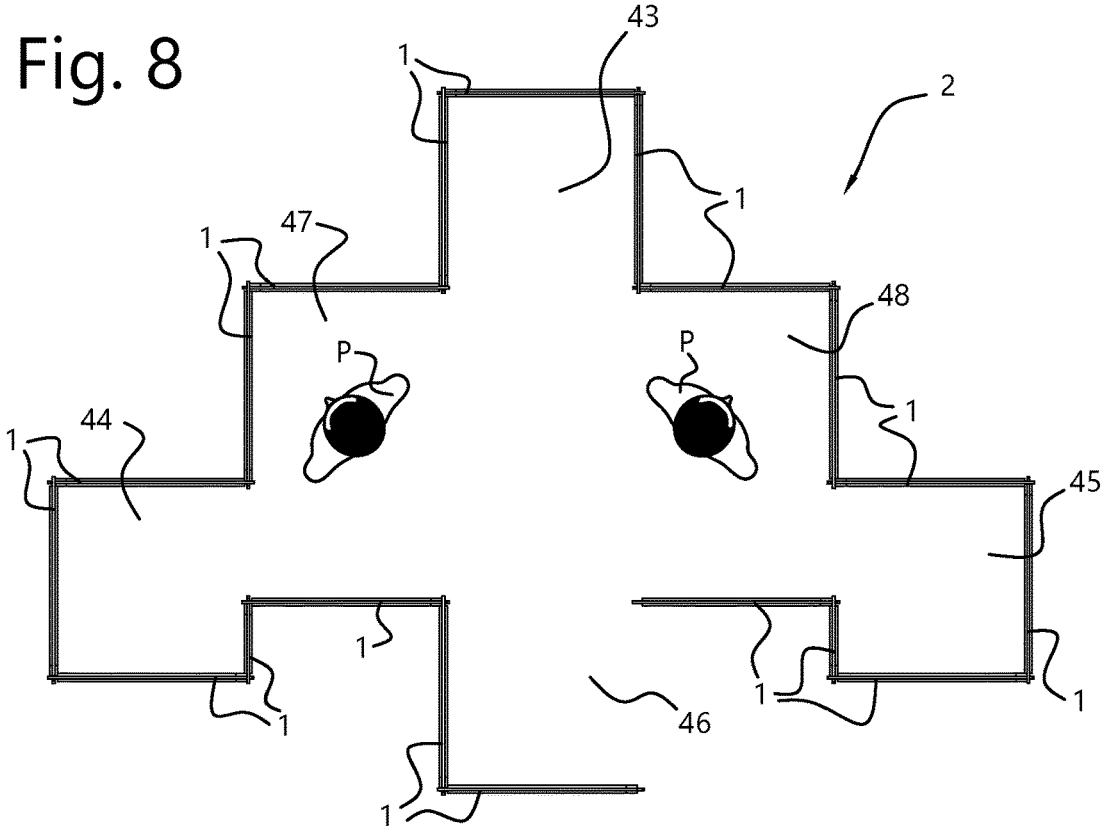

FIG. 8 depicts a second exemplary configuration of a ballistic wall assembly 2 of three U-shaped enclosures 43, 44, 45 for protecting a person P. The entrance/exit 46 is provided to allow a person P to enter or leave the ballistic wall assembly 2. In this configuration the three enclosures 43, 44, 45 are separated by a 90° degree or L-shaped enclosure 47, 48 formed by two engaging ballistic panels 1. Note that in this exemplary embodiment the main plate members 3 of ballistic panels 1 need not all have the same width Wp.

Figure 9:
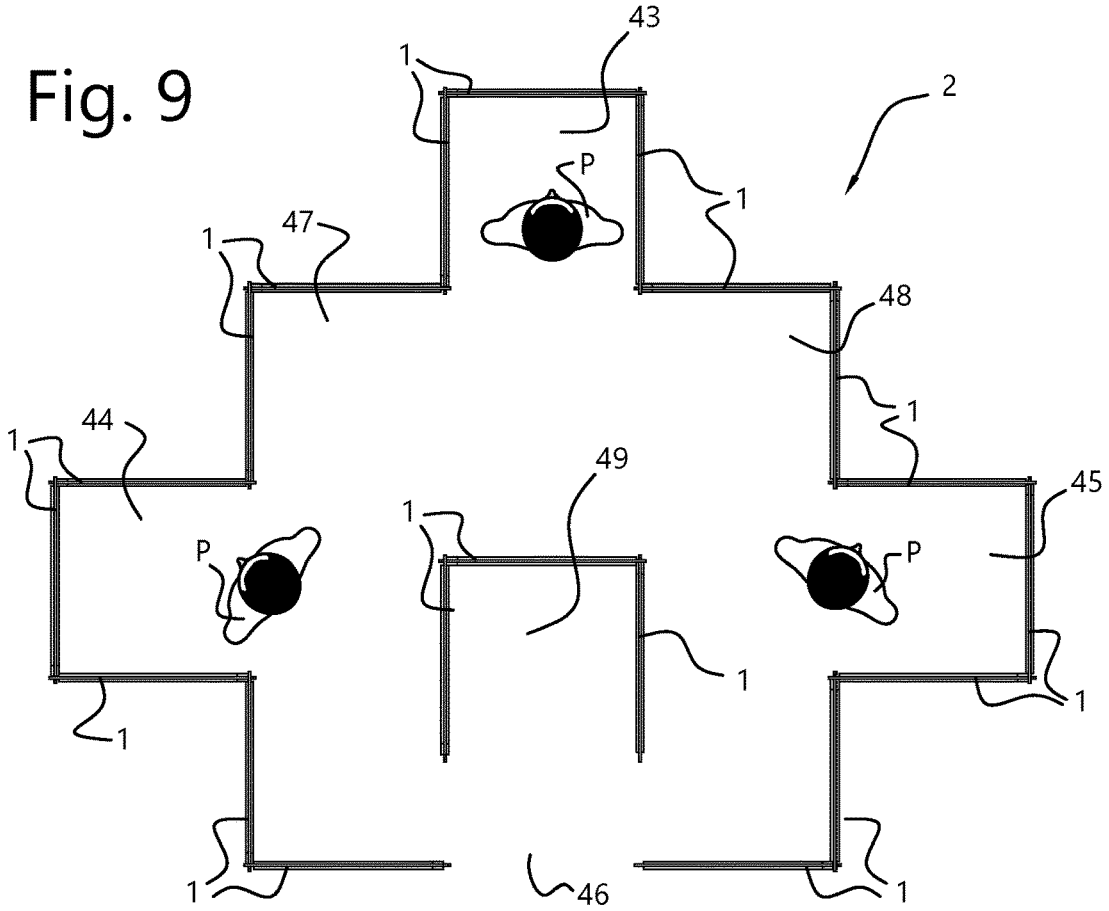
FIG. 9 shows a plan view of a third configuration of a ballistic wall assembly according to an embodiment of the present invention.

FIG. 9 depicts a similar configuration as shown in FIG. 8, but now a separate fourth U-shaped enclosure 49 is provided formed by three ballistic panels 1 and wherein the U-shaped enclosure 49 stands on its own within the larger enclosure provided by the ballistic wall assembly 2. Such a separate inner U-shaped enclosure 49 may be used, for example, to protect the entrance/exit 46 from incoming projectiles, but also to provide further protection to a person P. In this exemplary embodiment the main plate members 3 of ballistic panels 1 appear to have the same width Wp, although this is not a requirement.

From the above it will be clear that the ballistic panel 1 allows for a large number of configurations for ballistic wall assemblies 2 to be built. Wherein a smallest 90° degree ballistic wall assembly 2 that is able to stand on its own is depicted in FIG. 4. All other configurations are, in principle, an arbitrary sequence of 90° degree engaging ballistic panels 1, wherein one of two sides of the ballistic panel 1 that engages another ballistic panel 1*a* determines a direction or shape of the wall assembly 2. Most notably and advantageously, each configuration are inherently stable, wherein a wall stand 36 as mentioned above can be used when higher level of stability are needed.

In view of the above, the present invention can now be summarised by the following embodiments:

Embodiment 1. A ballistic panel (1) for assembling a ballistic wall assembly (2), comprising a planar main plate member (3) of ballistic material comprising a top edge (4) and an opposing bottom edge (5), and a first side edge (6) and an opposing second side edge (7);

two spaced apart L-shaped hook members (8, 9) arranged along the first side edge (6), wherein each hook member (8, 9) comprises a base portion (10, 11) and a leg portion (12, 13), wherein the base portion (10, 11) is connected to the first side edge (6), and wherein the leg portion (12, 13) is connected to the base portion (10, 11) and extends away therefrom parallel to the first side edge (6) toward the top edge (4), and wherein a gap/slit (14, 15) is provided between the leg portion (12, 13) and the first side edge (6);

wherein the main plate member (3) further comprises two spaced apart slots (16, 17) each of which is arranged opposite to a corresponding opposing hook member (8, 9) of the two hook members (8, 9) and extending along the second side edge (7), and wherein each slot (16, 17) is configured to releasably receive one of two L-shaped hook members (8*a*, 9*a*) of another/further ballistic panel (1*a*).

Embodiment 2. The ballistic panel according to embodiment 1, wherein each slot (16, 17) comprises a slot length (Ls) equal to or larger than a hook length (Lh) of the corresponding opposing hook member (8, 9); and wherein each slot (16, 17) comprises a slot width (Ws) equal to or larger than a hook width (Wh) of the opposing hook member (8, 9).

Embodiment 3. The ballistic panel according to embodiment 1 or 2, wherein the gap (14, 15) between the leg portion (12, 13) of each hook member (8, 9) and the first side edge (6) is equal to or larger than a thickness (T) of the main plate member (3).

Embodiment 4. The ballistic panel according to any of embodiments 1-3, wherein the leg portion (12, 13) of each hook member (8, 9) comprises a tapered end (18, 19) distal to the base portion (10, 11).

Embodiment 5. The ballistic panel according to any of embodiments 1-4, wherein the main plate member (3) and the two hook members (8, 9) form a single piece component.

Embodiment 6. The ballistic panel according to any of embodiments 1-5, wherein the main plate member (3) is rectangular or square and wherein the top edge (4), bottom edge (5), first side edge (6) and the second side edge (7) are straight edges.

Embodiment 7. The ballistic panel according to any of embodiments 1-6, further comprising two bottom edge plates (20, 21) of ballistic material attached to the main plate member (3) along the bottom edge (5) thereof and wherein the two bottom edge plates (20, 21) are arranged in opposing fashion on/along either side of the main plate member (3), and wherein each of the two bottom edge plates (20, 21) extends beyond the bottom edge (5) of the main plate member (3) by an extending distance (d) larger than zero.

Embodiment 8. The ballistic panel according to any of embodiments 1-7, further comprising two side edge plates (22, 23) of ballistic material attached to the main plate member (3) along the first side edge (6) thereof and wherein the two side edge plates (22, 23) are arranged in opposing fashion on/along either side of the main plate member (3), and wherein each of the two side edge plates (22, 23) comprises an abutment side edge (24, 25) arranged flush with the first side edge (6) of the main plate member (3).

Embodiment 9. The ballistic panel according to embodiment 7 and 8, wherein each bottom edge plate (20, 21) and each side edge plate (22, 23) that are arranged on a common side (i.e. a same side) of the main plate member (3) form a single piece edge plate.

Embodiment 10. The ballistic panel according to any of embodiments 1-9, when depending from embodiment 7, wherein each of the two slots (16, 17) comprises a bottom slot end (26, 27) and wherein each of the two hook members (8, 9) comprises a bottom hook end (28, 29), and wherein each bottom slot end (26, 27) is offset by an offset distance (0) of at least the extending distance (d) toward the bottom edge (5) with respect or relative to the corresponding opposing bottom hook end (28, 29).

Embodiment 11. The ballistic panel according to any of embodiments 1-10, wherein each of the two slots (16, 17) comprises a top slot end (30, 31) and wherein each of the two hook members (8, 9) comprises a gap bottom (32, 33), and wherein each top slot end (30, 31) is arranged at an equal or smaller distance (Ds1, Ds2) from the top edge (4) of the main plate member (3) than a distance (Dh1, Dh2) of the corresponding opposing gab bottom (32, 33) of an opposing hook member (8, 9).

Embodiment 12. The ballistic panel according to any of embodiments 1-11, wherein the main plate member (3) comprises one or more holes (34, 35) arranged along the top edge (4) of the main plate member (3).

Embodiment 13. The ballistic panel according to embodiment 12, when depending from embodiment 7, wherein the one or more holes (34, 35) are arranged at a distance (Eh) from the top edge (4) of the main plate member (3) of less than (i.e. smaller than) the extending distance (d) of the two bottom edge plates (20, 21).

Embodiment 14. The ballistic panel according to any of embodiments 1-13, wherein the main plate member (3) has a width (Wp) and height (Hp) each of which is equal to or less/smaller than 1.5 meter.

Embodiment 15. A wall stand (36) configured to support a corner (37) between two horizontally engaging ballistic panels (1, 1*a*), wherein each ballistic panel (1, 1*a*) is a ballistic panel according to any of embodiments 1-14.

The present invention has been described above with reference to a number of exemplary embodiments as shown in the drawings. Modifications and alternative implementations of some parts or elements are possible, and are included in the scope of protection as defined in the appended claims.

The invention claimed is:

1. A ballistic panel for assembling a ballistic wall assembly, comprising a planar main plate member of ballistic material comprising a top edge and an opposing bottom edge, and a first side edge and an opposing second side edge;

two spaced apart L-shaped hook members arranged along the first side edge, wherein each hook member comprises a base portion and a leg portion, wherein the base portion is connected to the first side edge, and wherein the leg portion is connected to the base portion and extends away therefrom parallel to the first side edge toward the top edge, and wherein a gap/slit is provided between the leg portion and the first side edge;

wherein the main plate member further comprises two spaced apart slots each of which is arranged opposite to a corresponding opposing hook member of the two hook members and extending along the second side edge, and wherein each slot is configured to releasably receive one of two L-shaped hook members of another/further ballistic panel, wherein each of the two slots comprises a top slot end and wherein each of the two hook members comprises a gap bottom, and wherein each top slot end is arranged at an equal or smaller distance (Ds1, Ds2) from the top edge of the main plate member than a distance (Dh1, Dh2) of the corresponding opposing gap bottom of an opposing hook member.

2. The ballistic panel according to claim 1, wherein each slot comprises a slot length (Ls) equal to or larger than a hook length (Lh) of the corresponding opposing hook member; and wherein each slot comprises a slot width (Ws) equal to or larger than a hook width (Wh) of the opposing hook member.

3. The ballistic panel according to claim 1, wherein the gap between the leg portion of each hook member and the first side edge is equal to or larger than a thickness (T) of the main plate member.

4. The ballistic panel according to claim 1, wherein the leg portion of each hook member comprises a tapered end distal to the base portion.

5. The ballistic panel according to claim 1, wherein the main plate member and the two hook members form a single piece component.

6. The ballistic panel according to claim 1, wherein the main plate member is rectangular or square and wherein the top edge, bottom edge, first side edge and the second side edge are straight edges.

7. The ballistic panel according to claim 1, further comprising two bottom edge plates of ballistic material attached to the main plate member along the bottom edge thereof and wherein the two bottom edge plates are arranged in opposing fashion on/along either side of the main plate member, and wherein each of the two bottom edge plates extends beyond the bottom edge of the main plate member by an extending distance (d) larger than zero.

8. The ballistic panel according to claim 7, wherein each bottom edge plate and each side edge plate that are arranged on a common side of the main plate member form a single piece edge plate.

9. The ballistic panel according to claim 7, wherein each of the two slots comprises a bottom slot end and wherein each of the two hook members comprises a bottom hook end, and wherein each bottom slot end is offset by an offset distance (O) of at least the extending distance (d) toward the bottom edge with respect or relative to the corresponding opposing bottom hook end.

10. The ballistic panel according to claim 1, further comprising two side edge plates of ballistic material attached to the main plate member along the first side edge thereof and wherein the two side edge plates are arranged in opposing fashion on/along either side of the main plate member, and wherein each of the two side edge plates comprises an abutment side edge arranged flush with the first side edge of the main plate member.

11. The ballistic panel according to claim 1, wherein the main plate member comprises one or more holes arranged along the top edge of the main plate member.

12. The ballistic panel according to claim 11, further comprising two bottom edge plates of ballistic material attached to the main plate member along the bottom edge thereof and wherein the two bottom edge plates are arranged in opposing fashion on/along either side of the main plate member, and wherein each of the two bottom edge plates extends beyond the bottom edge of the main plate member by an extending distance (d) larger than zero, wherein the one or more holes are arranged at a distance (Eh) from the top edge of the main plate member of less than the extending distance (d) of the two bottom edge plates.

13. The ballistic panel according to claim 1, wherein the main plate member has a width (Wp) and height (Hp) each of which is equal to or less/smaller than 1.5 meter.

14. A wall stand configured to support a corner between two horizontally engaging ballistic panels wherein each ballistic panel is a ballistic panel according to claim 1.

15. A ballistic panel for assembling a ballistic wall assembly, comprising a planar main plate member of ballistic material comprising a top edge and an opposing bottom edge, and a first side edge and an opposing second side edge;

two spaced apart L-shaped hook members arranged along the first side edge, wherein each hook member comprises a base portion and a leg portion, wherein the base portion is connected to the first side edge, and wherein the leg portion is connected to the base portion and extends away therefrom parallel to the first side edge toward the top edge, and wherein a gap/slit is provided between the leg portion and the first side edge;

wherein the main plate member further comprises two spaced apart slots each of which is arranged opposite to a corresponding opposing hook member of the two hook members and extending along the second side edge, and wherein each slot is configured to releasably receive one of two L-shaped hook members of another/further ballistic panel, and two bottom edge plates of ballistic material attached to the main plate member along the bottom edge thereof and wherein the two bottom edge plates are arranged in opposing fashion on/along either side of the main plate member, and wherein each of the two bottom edge plates extends beyond the bottom edge of the main plate member by an extending distance (d) larger than zero.

16. The ballistic panel according to claim 15, wherein each bottom edge plate and each side edge plate that are arranged on a common side of the main plate member form a single piece edge plate.

17. The ballistic panel according to claim 15, wherein each of the two slots comprises a bottom slot end and wherein each of the two hook members comprises a bottom hook end, and wherein each bottom slot end is offset by an offset distance (O) of at least the extending distance (d) toward the bottom edge with respect or relative to the corresponding opposing bottom hook end.

* * * * *